US009163552B2

(12) United States Patent
Iida et al.

(10) Patent No.: US 9,163,552 B2
(45) Date of Patent: Oct. 20, 2015

(54) WATER COOLED INTERNAL COMBUSTION ENGINE FOR VEHICLE

(71) Applicant: HONDA MOTOR CO., LTD., Tokyo (JP)

(72) Inventors: Akihiro Iida, Wako (JP); Yuichi Mori, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 26 days.

(21) Appl. No.: 13/919,221

(22) Filed: Jun. 17, 2013

(65) Prior Publication Data

US 2014/0060465 A1 Mar. 6, 2014

(30) Foreign Application Priority Data

Aug. 31, 2012 (JP) ..... 2012-191525

(51) Int. Cl.

| | |
|---|---|
| ***F01P 5/10*** | (2006.01) |
| ***F02F 1/10*** | (2006.01) |
| ***F02F 1/14*** | (2006.01) |
| ***F02B 61/02*** | (2006.01) |
| *F02P 5/12* | (2006.01) |
| *F02F 7/00* | (2006.01) |

(52) U.S. Cl.

CPC . *F01P 5/10* (2013.01); *F02B 61/02* (2013.01); *F02F 7/007* (2013.01); *F02P 5/12* (2013.01)

(58) Field of Classification Search

CPC ..... F01P 5/10; F01P 5/12; F01P 7/164; F01P 3/02; F02B 61/045; F02F 1/10; F02F 1/14; F02F 1/16

USPC ..... 123/41.47, 41.44, 41.79

See application file for complete search history.

(56) References Cited

U.S. PATENT DOCUMENTS

| | | | | |
|---|---|---|---|---|
| 6,912,982 | B2 * | 7/2005 | Lehmann et al. | 123/90.15 |
| 6,912,987 | B2 * | 7/2005 | Tachibana et al. | 123/198 R |
| 7,343,883 | B2 * | 3/2008 | Emmersberger | 123/41.44 |
| 2003/0037752 | A1 * | 2/2003 | Nomura | 123/192.2 |
| 2006/0065215 | A1 * | 3/2006 | Wachigai et al. | 123/41.1 |
| 2012/0073527 | A1 * | 3/2012 | Oltmans et al. | 123/41.47 |

FOREIGN PATENT DOCUMENTS

JP 2007-315199 A 12/2007

* cited by examiner

*Primary Examiner* — Lindsay Low
*Assistant Examiner* — Syed O Hasan
(74) *Attorney, Agent, or Firm* — Birch, Stewart, Kolasch & Birch, LLP

(57) ABSTRACT

A compact water cooled internal combustion engine for a vehicle wherein a water pump operated by a pump driving shaft is arranged on a crankcase cover for covering a lateral side of a crankcase, such that an axis of rotation of the water pump is coaxial with the pump driving shaft. A case member that forms a pump case of a water pump, together with a crankcase cover, and that rotatably supports a pump shaft of the water pump, is attached on an inner surface side of the crankcase cover.

20 Claims, 9 Drawing Sheets

WATER COOLED INTERNAL COMBUSTION ENGINE FOR VEHICLE

CROSS-REFERENCE TO RELATED APPLICATIONS

The present application claims priority under 35 USC 119 to Japanese Patent Application No. 2012-191525 filed Aug. 31, 2012 the entire contents of which are hereby incorporated by reference.

BACKGROUND OF THE INVENTION

1. Field of the Invention

The present invention relates to a water cooled internal combustion engine for a vehicle, wherein a crankcase cover for covering a lateral side of a crankcase is attached to the crankcase that forms a portion of an engine main body mounted on a vehicle body frame and that rotatably supports a crankshaft. A pump driving shaft, operated by power transmitted from the crankshaft, is rotatably supported on an axis parallel to the crankshaft by the crankcase. A water pump to be driven through the pump driving shaft has an axis of rotation that is coaxial with the pump driving shaft and is arranged on the crankcase cover.

2. Description of Background Art

A water cooled internal combustion engine for a vehicle is known that includes a pump case for a water pump to be driven by power transmitted from a crankshaft which is rotatably supported by a crankcase that is composed of a crankcase cover that covers the crankcase and rotatably supports a pump shaft of the water pump and of a pump cover that is fixedly attached to the crankcase cover from the outside. See, Japanese patent laid-open publication No. 2007-315199.

However, the engine disclosed in Japanese patent laid-open publication No. 2007-315199, has a construction wherein after attaching a crankcase cover to a crankcase, a pump cover is fixedly attached on the crankcase cover from the outside. Accordingly, tightening members arranged on an outer periphery of the pump cover remain exposed outside whereby there is a possibility of injuring an external appearance. In addition, there is a possibility that the internal combustion engine is increased in size in the direction along the crankshaft. More particularly, in the water cooled internal combustion engine to be mounted on a straddle type vehicle such as a two-wheeled motorcycle and the like, it is required that the size in the width direction of the internal combustion engine should be made to be compacted so as to obtain a good straddling comfort of a rider.

SUMMARY AND OBJECTS OF THE INVENTION

The present invention has been made in view of the above described circumstances, and has an objective according to an embodiment of providing a water cooled internal combustion engine for a vehicle, that is capable of improving the external appearance so as to be compact in size in the width direction, wherein a water pump is arranged on a crankcase cover.

In order to achieve the above object, according to an embodiment of the present invention, there is provided a water cooled internal combustion engine for a vehicle comprising a crankcase constituting a portion of an engine main body mounted on a vehicle body frame and rotatably supporting a crankshaft, a crankcase cover for covering a lateral side of the crankcase, being attached to the crankcase. A pump driving shaft is operated by power transmitted from the crankshaft and is rotatably supported on an axis parallel to the crankshaft by the crankcase. A water pump is driven through the pump driving shaft with an axis or rotation coaxial with the pump driving shaft and being arranged on the crankcase cover. A case member that forms a pump case of the water pump, together with the crankcase cover, and which rotatably supports a pump shaft of the water pump, is attached on an inner surface side of the crankcase cover.

According to an embodiment of the present invention, there is provided a water passage section that is a portion of a water supply passage leading cooling water discharged from the water pump to a water jacket formed in the engine main body, wherein the water passage section is formed between joining surfaces of the crankcase cover and the case member.

According to an embodiment of the present invention, there is provided a second water passage section being formed in the crankcase while constituting a portion of the water supply passage, wherein the water passage section formed between the joining surfaces of the crankcase cover and the case member is in communication with the second water passage section.

According to an embodiment of the present invention, there are provided a first cooling water inlet pipe portion for introducing cooling water having circulated through a radiator, into the water pump, and a second cooling water inlet pipe portion for introducing into the water pump the cooling water from a water bypass passage which leads the cooling water circulating, while bypassing the radiator, from the water jacket formed in the engine main body, wherein the first and second cooling water inlet pipe portions are provided on the crankcase cover.

According to an embodiment of the present invention, a relative arrangement between the first and second cooling water inlet pipe portions each of which extends rectilinearly is configured such that extension lines of central axes of these cooling water inlet pipe portions intersect each other at a rotation axis of the water pump.

According to an embodiment of the present invention, the pump driving shaft functions as a balancer shaft which is operatively connected to the crankshaft.

According to an embodiment of the present invention, one of a projection and a groove is provided on an end portion of the balancer shaft, and the other of the projection and the groove is provided on an end surface of the pump shaft which is coaxial with the balancer shaft and corresponds to the end portion of the balancer shaft, so as to be engaged with the one of the projection and the groove.

According to an embodiment of the present invention, there is provided a balancer weight having a recess for staying clear of the case member of the water pump is provided on the one end portion of the balancer shaft coaxially opposite to the pump shaft on the side external to the crankcase.

According to an embodiment of the present invention, since the pump case of the water pump includes the crank case cover and the case member which rotatably supports the pump shaft and which is attached to the inner surface side of the crankcase cover, tightening members are not exposed on the outer surface side of the crankcase cover whereby to improve the external appearance. The pump case does not project from the crank case cover whereby it is possible to provide a compact internal combustion engine in the width direction.

According to an embodiment of the present invention, since the water passage section that is a portion of the water supply passage leading the cooling water from the water pump to a water jacket is formed between the joining surfaces of the crankcase cover and the case member, there is no need for a discharge pipe portion for discharging the cooling water from the water pump to be provided on the pump case in a projecting fashion from the pump case. Thus, it is possible to make the internal combustion engine more compact.

According to an embodiment of the present invention, since the water passage section formed between the joining surfaces of the crankcase cover and the case member is in communication with the second water passage section formed in the crankcase, the water passage section extending from the water pump to the crankcase is housed in the inside of the internal combustion engine, whereby the number of component parts can be reduced and the external appearance can be improved.

According to an embodiment of the present invention, the first cooling water inlet pipe portion for introducing the cooling water from the radiator into the water pump, and the second cooling water inlet pipe portion introducing into the water pump the cooling water from the water bypass passage that leads the cooling water bypassing the radiator, are provided on the crankcase cover. Therefore, in comparison with the construction in which the first and second cooling water inlet pipe portions are arranged on a pump cover that is attached to the crankcase from the outside, the internal combustion engine can be made to be compact in size. In addition, there is no need for avoiding the location where the case member is fastened to the crankcase cover in order for arranging the first and second cooling water inlet pipe portions, whereby it is possible to increase a degree of freedom of arrangement with respect to the first and second cooling water inlet pipe portions.

According to an embodiment of the present invention, since the extension lines of the central axes of the first and second rectilinear cooling water inlet pipe portions intersect each other at the axis of rotation of the water pump, the first and second cooling water inlet pipe portions are prevented from protruding from the crankcase cover, whereby the internal combustion engine can be more compact.

According to an embodiment of the present invention, since the pump driving shaft functions as a balancer shaft, there is no need for providing an exclusive pump driving shaft to operate the water pump, whereby the number of component parts can be reduced. In addition, there is no need for providing an arrangement space for the exclusive pump driving shaft, whereby the internal combustion engine can be compact in size.

According to an embodiment of the present invention, since the pump shaft is operated by the coaxial projection and groove engagement between the balancer shaft and the pump shaft, there is no need for providing an exclusive connecting member such as a tightening means and the like for connecting the balance shaft and the pump shaft, whereby the number of component parts can be reduced and the assembling operation can be easily performed.

According to an embodiment of the present invention, since the balancer weight is provided on the one end portion of the balancer shaft on the side external to the crankcase, the balancer shaft and the crankshaft can be arranged close to each other, so that the engine main body can be compact in the direction orthogonal to an axis of the crankshaft. Moreover, since the balancer weight has a recess for staying clear of the case member of the water pump, the balancer shaft and the case member can be arranged close to each other. Thus, it is possible to make the internal combustion engine more compact in the direction along the axis of the crankshaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The embodiment of the present invention will be described hereunder with reference to accompanying drawings of FIG. 1 to FIG. 9. In the following description, the orientation such as front, rear, upper, lower, left and right is set on the basis of a rider riding on a motorcycle.

Figure 1:
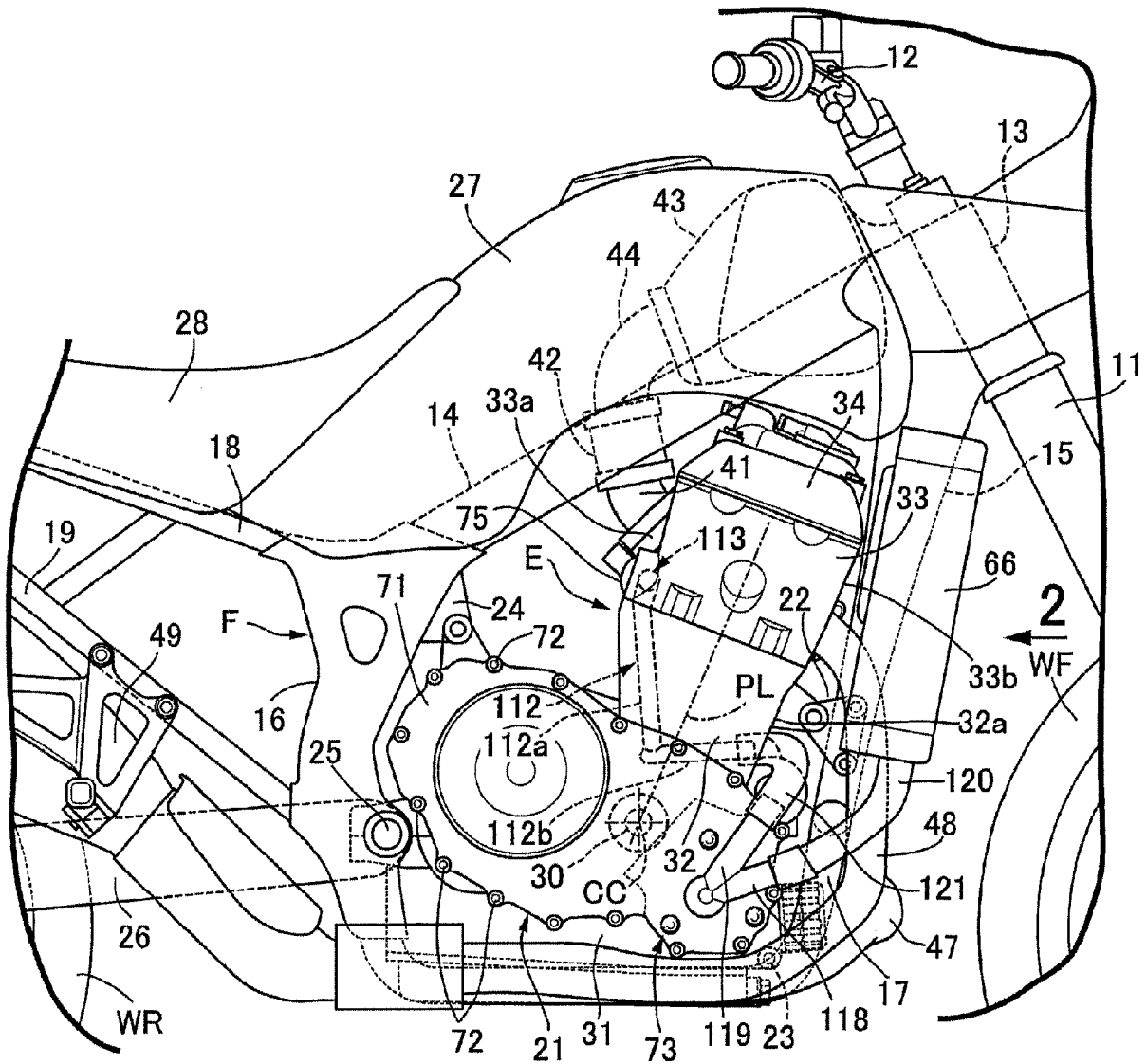
FIG. 1 is a right side elevational view showing a part of a motorcycle.
Figure 2:
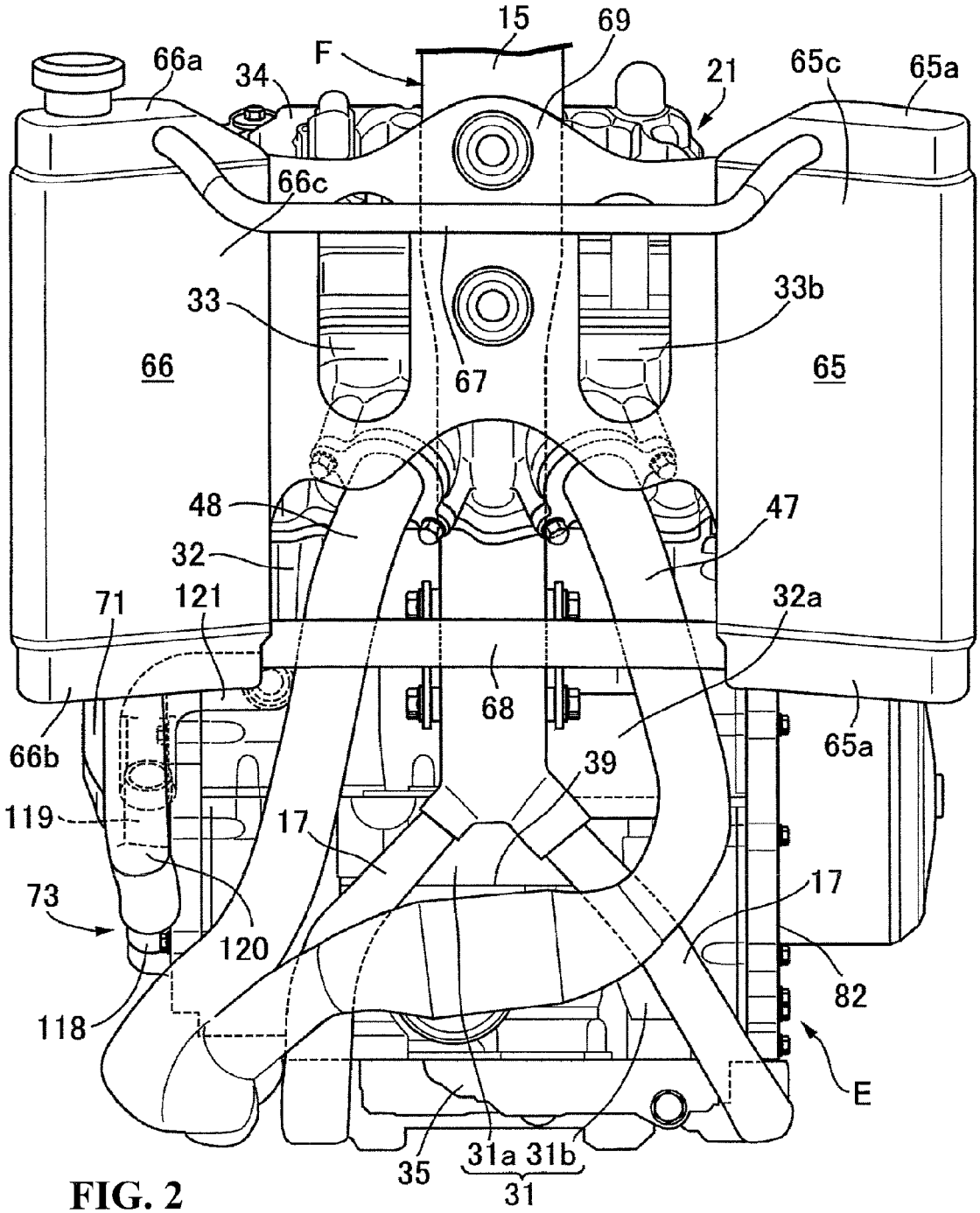
FIG. 2 is a view in the direction of an arrow 2 of FIG. 1.

Referring first to FIGS. 1 and 2, a vehicle body frame F of the motorcycle includes a head pipe 13 that steerably supports a front fork 11 for pivotally carrying a front wheel WF and a bar-shaped steering handle 12 with a pair of left and right main frames 14 extending rearwardly and downwardly from the head pipe 13. A single down tube 15 extends rearwardly and downwardly from the head pipe 13 at a steeper angle than the main frames 14. A pair of left and right pivot frames 16 extend downwardly from rear end portions of the main frames 14 with a pair of left and right lower frames 17 connecting a lower end portion of the down tube 15 and lower end portions of the pivot frames 16. A pair of left and right seat rails 18 extend rearwardly and upwardly from upper end portions of the pivot frames 16 with a pair of left and right rear frames 19 connecting intermediate portions of the pivot frames 16 and intermediate portions of the seat rails 18.

An engine main body 21 of a water cooled internal combustion engine E is mounted on the vehicle body frame E in a state of being surrounded by the main frames 14, the down tube 15, the pivot frames 16 and the lower frames 17. The engine main body 21 is supported by mount brackets 22, 23, 24 that are provided each on a lower portion of the down tube 15, on front portions of the lower frames 17 and upper portions of the pivot frames 16. The engine main body 21 also is supported through a spindle 25 on lower portions of the pivot frames 16. A front end portion of a swing arm 26 that pivotally supports a rear wheel WR on a read end portion thereof is supported in an upward and downward swingable fashion through the spindle 25 by the pivot frames 16.

A fuel tank 27 is carried on the main frames 14 in such a manner so as to cover the engine main body 21 from the upper side. A riding seat 28 arranged to the rearward of the fuel tank 27 is carried by the seat rails 18.

Referring to FIGS. 3 through 7, the engine main body 21 is formed into a parallel two cylinder engine and includes a crankcase 31 on which is rotatably supported a crankshaft 30 extending in the width direction of the motorcycle, a cylinder block 32 connected to a front part of the crankcase 31 and having two cylinder bores 37, 37 arranged in parallel in such a manner so as to allow pistons 36, 36 connected to the crankshaft 30 to be slidably fitted therein. A cylinder head 33 is connected to an upper part of the cylinder block 32 such that combustion chambers 38, 38 to which each top of the pistons 36 faces are formed for each cylinder by the cylinder head 33 and the cylinder block 32. A head cover 34 is connected to the cylinder head 33. An oil pan is attached to a lower end portion of the crankcase 31.

The crankcase 31 is composed of an upper half case body 31*a* formed integral with the cylinder block 32 and a lower half case body 31*b* that are connected to each other in a manner to be divided on a division surface 39 in an upward and downward direction. The crankshaft 30 is rotatably supported between the upper and lower half case bodies 31*a*, 31*b*.

The cylinder block 32 is formed integral with a front part of the upper half case body 31*a* of the crankcase 31 such that an axis C of each of the cylinder bores 37 is inclined forwardly and upwardly. The engine main body 21 is mounted on the vehicle body frame F in such a condition that the cylinder block 32, the cylinder head 33 and the head cover 34 are inclined forwardly and upwardly.

Intake ports 40, 40 of each cylinder are provided on a rearward wall 33*a* of the cylinder head 33. To the rearward wall 33*a* of the cylinder head 33 there is connected a pair of intake pipes 41 with a downstream side communicating with each of the intake ports 40. To each of upstream ends of the intake pipes 41 there is connected each of downstream ends of throttle bodies 42. Moreover, above the engine body 21 there is arranged an air cleaner 43 such as to be covered with the fuel tank 27 from the upper side. Each of upstream ends of the throttle bodies 42 is connected to the air cleaner 43 through each of connecting tubes 44 provided corresponding to these throttle bodies 42.

Exhaust ports 46, 46 of each cylinder are provided on a forward wall 33*b* of the cylinder head 33. A pair of exhaust pipes 47, 48 extending to each of the exhaust ports 46 is connected on an upstream end side thereof to the forward wall 33*b* of the cylinder head 33. These exhaust pipes 47, 48 extend from the front side of the engine main body 21 through the under side of the engine main body 21 to the rear side thereof. Both downstream ends of the exhaust pipes 47, 48 are connected to an exhaust muffler 49 which is arranged on the right side of the rear wheel WR.

Figure 7:
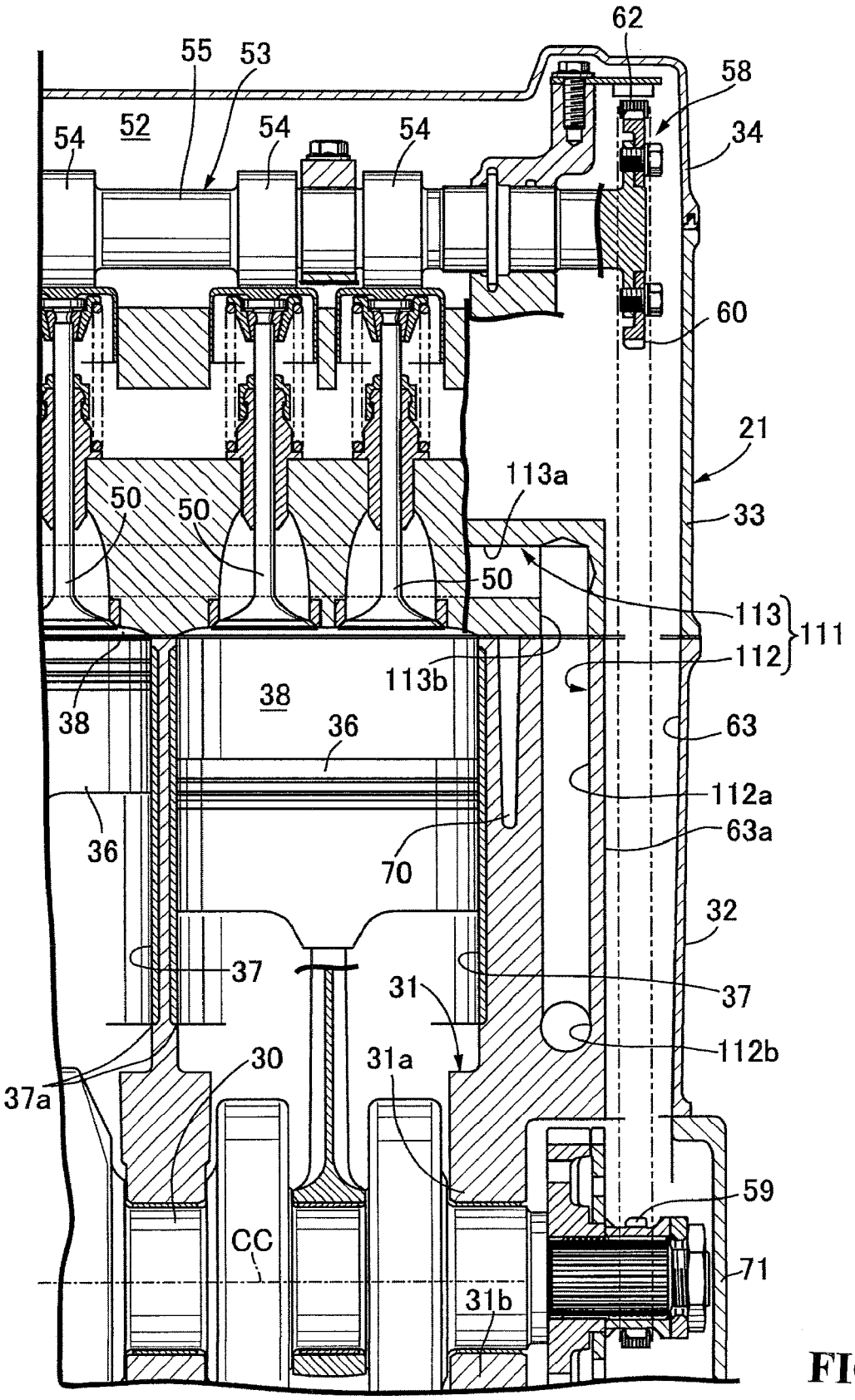
FIG. 7 is an enlarged cross sectional view taken along line 7-7 of FIG. 6.

Referring to FIG. 7, in the cylinder head 33, intake valves 50, 50 for switching the connection and disconnection between the intake ports 40 and the combustion chambers 38 are arranged in pairs with one pair for each cylinder in the openable and closable fashion, while exhaust valves 51, 51 (see FIG. 3) for switching the connection and disconnection between the exhaust ports 46 and the combustion chambers 38 are arranged in pairs with one pair for each cylinder in the openable and closable fashion.

The intake valves 50 and the exhaust valves 51 are operated to opening and closing positions by a valve operating mechanism 53 that is housed in a valve operating chamber 52 defined between the cylinder head 33 and the head cover 34. The valve operating mechanism 53 is provided with an intake side valve operating cam shaft 55 having a plurality of intake side cams 54 that press and operate each of the intake valves 50 and with an exhaust side valve operating cam shaft 57 (see FIG. 3) having a plurality of exhaust side cams 56 (see FIG. 3) that press and operate each of the exhaust valves 51. The intake side valve operating cam shaft 55 and the exhaust side valve operating cam shaft 57 have axes parallel to the crankshaft 30 and are rotatably supported by the cylinder head 33 so as to be rotatable around each of the axes.

To the intake side valve operating cam shaft 55 and the exhaust side valve operating cam shaft 57, rotational power from the crankshaft 30 is transmitted through a timing transmission mechanism 58. The timing transmission mechanism 58 comprises a drive sprocket 59 fixedly secured to a right end portion of the crankshaft 30 on the side external to the crankcase 31, an intake side driven sprocket 60 fixedly secured to a right end portion of the intake side valve operating cam shaft 55, an exhaust side driven sprocket 61 (see FIG. 3) fixedly secure to a right end portion of the exhaust side valve operating cam shaft 57, and an endless cam chain 62 being wrapped around these three sprockets.

Further, a cam chain chamber 63 for running the cam chain 62 is formed in the crankcase 31, the cylinder block 32 and cylinder head 33 of the engine main body 21. On a lower portion of a rear wall of the cylinder head 33 corresponding to the cam chain chamber 63 there is integrally formed a mounting boss 64 for attaching thereto a cam chain tensioner (not shown) that comes in sliding contact with a loose side of the cam chain 62 in order to place tension on the cam chain 62.

Referring to FIGS. 1 and 2, in front of the engine main body there is arranged a pair of left and right radiators 65, 66 that is separated on both sides of the down tube 15. These radiators 65, 66 include upper tanks 65*a*, 66*a*, lower tanks 65*b*, 66*b*, and cooling cores 65*c*, 66*c* provided between the upper and lower tanks. A support plate 69 for supporting each of the cooling cores 65*c*, 66*c* of the radiators 65, 66 is fixedly attached to the down tube 15.

In addition, the upper tanks 65*a*, 66*a* of the radiators 65, 66 are connected by an upper connecting tube 67, while the lower tanks 65*b*, 66*b* of the radiators 65, 66 are connected by a lower connecting tube 68.

A water jacket 70 for circulating cooling water is formed in the cylinder block 32 and the cylinder head 33 of the engine main body 21. On a right lateral side of the crankcase 31, a crankcase cover 71 for covering the right lateral side thereof is attached by a plurality of bolts 72, 72. A water pump 73 for supplying the cooling water to the water jacket 70 is arranged on the crankcase cover 71 such that it is located in a position overlapping with the crankcase 31 when viewed from the direction along an axis CC of the crankshaft 30.

Further, to the cylinder head 33 on the opposite side with respect to an imaginary plane PL including the axis CC of the crankshaft 30 and the axes C of the cylinder bores 37, there is attached a thermostat 74 that is changeable between a state in which the cooling water led from the water jacket 70 is led to the radiators 65, 66 and a state in which it bypasses the radiators 65, 66. In this embodiment, the thermostat 74 is arranged to the rear of the imaginary plane PL, while the water pump 73 is arranged in front of the imaginary plane PL.

Moreover, the thermostat 74 and the water pump 73 are arranged to put the cylinder bores 37 therebetween in the direction along the axis CC of the crankshaft 30. In this embodiment, the thermostat 74 is attached to the cylinder head 33 in such a manner so as to be accommodated in a thermostat housing 75 provided on a left end lower section of the rearward wall 33*a* of the cylinder head 33. The water pump 73 is arranged on the crankcase cover 71 attached to the right lateral side of the crankcase 31 in such a manner so as to put the pair of parallel cylinder bores 37 between the water pump 73 and the thermostat 74.

Figure 8:
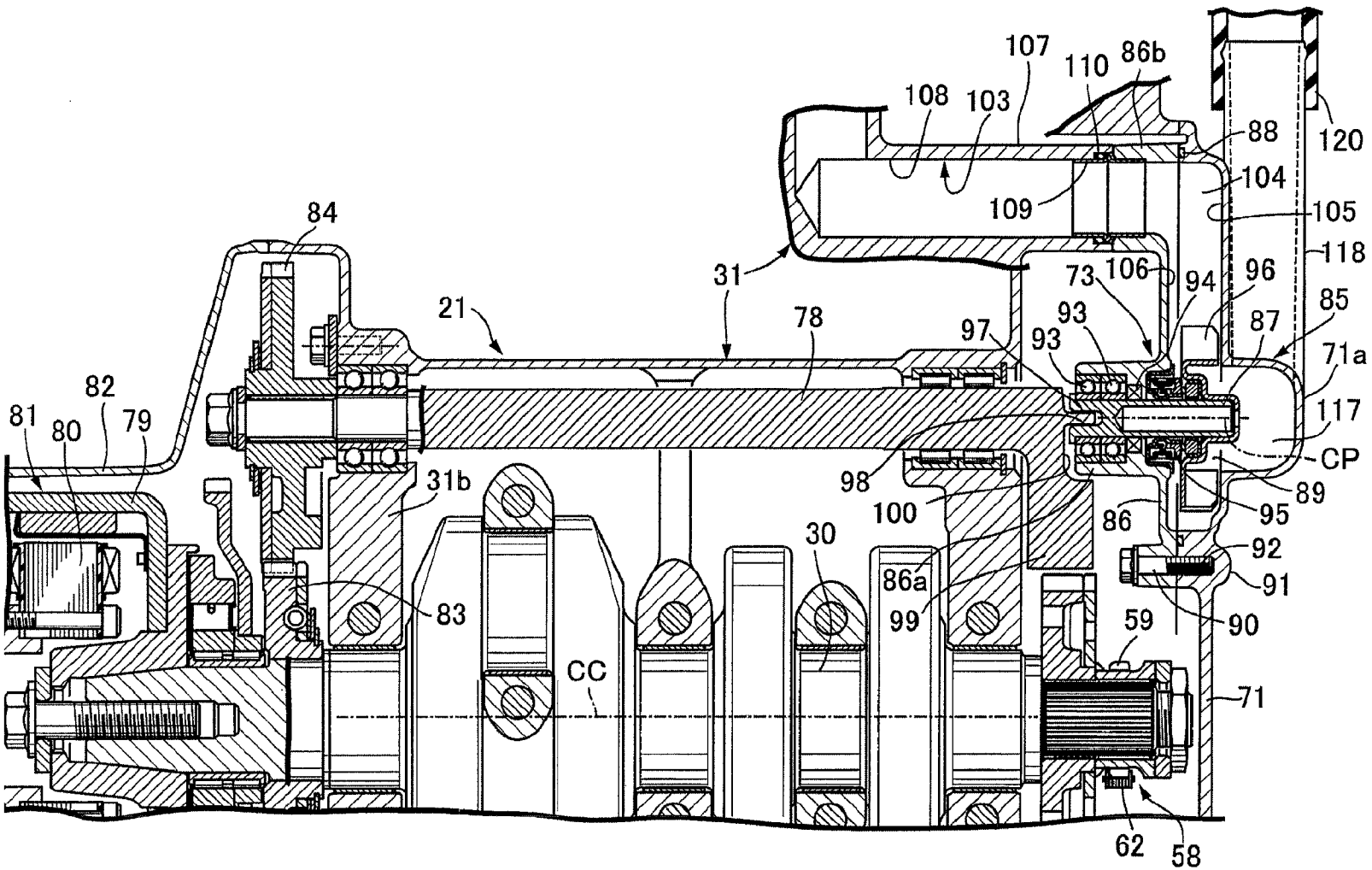
FIG. 8 is an enlarged cross sectional view taken along line 8-8 of FIG. 3.

Referring to FIG. 8, on the crankcase 31 there is rotatably supported a balancer shaft 78 that functions as a pump driving shaft operated by the power transmitted from the crankshaft 30 and that has an axis parallel to the crankshaft 30. The water pump 73 operated by the balancer shaft 78 is arranged on the crankcase cover 71 with its rotation axis, namely, a central axis CP of a pump shaft 87 extending coaxial with the axis of the balancer shaft 78.

A rotor 79 is fixedly secured to a left end portion of the crankshaft 30 on the side external to the crankcase 31. An electric generator 81 is composed of the rotor 79 and a stator 80 enclosed by the rotor 79. A generator cover 82 is securely attached to a left lateral surface of the crankcase 31 so as to cover the electric generator 81.

A drive gear 83 is fixedly secured to the crankshaft 30 between the electric generator 81 and the crankcase 31, while a driven gear 84 meshing with the drive gear 83 is fixedly secured to a left end portion of the balancer shaft 78. Namely, the rotational power of the crankshaft 30 is transmitted through the drive gear 83 and the driven gear 84 to the balancer shaft 78.

A pump case 85 of the water pump 73 is composed of the crankcase cover 71 and a case member 86 that is securely attached to an inner surface side of the crankcase cover 71 in a state of rotatably supporting the pump shaft 87 of the water pump 73. An endlessly extending seal member 88 is disposed between an outer periphery of the case member 86 and the inner surface of the crankcase cover 71.

The case member 86 is fastened on the inner surface of the crankcase cover 71 through a plurality of bolts 90 from the inner direction of the crankcase cover 71 in such a manner so as to form a pump chamber 89 between itself and the crankcase cover 71. A plurality of boss portions 91 that have bottomed threaded holes 92 to be engaged with the bolts 90 are integrally provided on the crankcase cover 71 in a state of partially projecting from the outer surface of the crankcase cover 71.

The case member 86 is integrally provided with a cylindrical shaft support section 86*a* through which the pump shaft 87 passes in a rotatable fashion and in which the pump shaft 87 is rotatably supported. Between the pump shaft 87 and the shaft support section 86*a*, a pair of ball bearings 93, 93, an annular seal member 94 and a mechanical seal 95 are arranged in order from the side of the balancer shaft 78 in the axial direction. In addition, an impeller 96 is fixedly secured to the pump shaft 87 within the pump chamber 89.

One of a projection and a groove is provided on an end portion (a right end portion in this embodiment) of the balancer shaft 78 on the side of the water pump 73, and the other of the projection and groove is provided on an end surface, corresponding to the end portion of the balancer shaft 78, of the pump shaft 87 which is coaxial with the balancer shaft 78, so as to be engaged with one of the projection and the groove. In this embodiment, the projection 97 is provided on the end portion of the balancer shaft 78, while the groove 98 to be engaged with the projection 97 is provided on the end surface of the pump shaft 87 corresponding to the end portion of the balancer shaft 78.

A balancer weight 99 with a recess 100 for staying clear of the case member 86 of the water pump 73 is provided on the end portion of the balancer shaft 78 that is coaxially opposite to the pump shaft 87 on the side external to the crankcase 31.

The cooling water discharged from the pump chamber 89 of the water pump 73 is led through a water supply passage 103 to the water jacket 70 of the engine main body 21. A first water passage section 104 that is a portion of the water supply passage 103 is formed between joining surfaces of the crankcase cover 71 and the case member 86.

More specifically, grooves 105, 106 formed each on the joining surfaces of the crankcase cover 71 and the case member 86 constitute the first water passage section 104 in cooperation with each other. In addition, the case member 86 is integrally provided with a connecting tube section 86*b* projecting towards the crankcase 31 side so as to communicate with the first water passage section 104.

Figure 9:
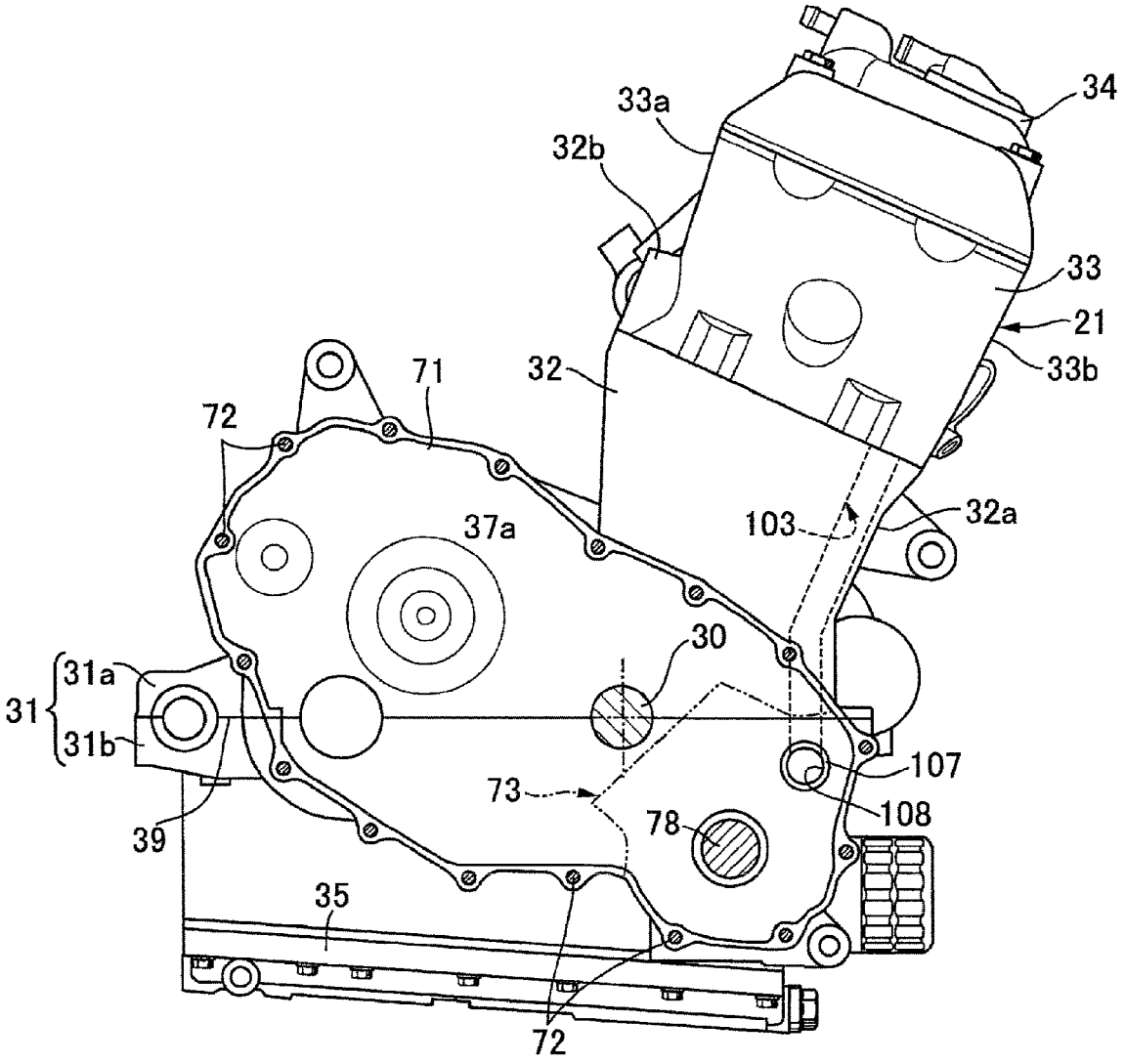
FIG. 9 is a cross sectional view taken along line 9-9 of FIG. 4.

Referring to FIG. 9, a second water passage section 108 constituting a portion of the water supply passage 103 is formed in the crankcase 31 and the cylinder block 32 to communicate with the water jacket 70. The crankcase 31 is integrally provided with a cylindrical section 107 that constitutes a portion of the second water passage section 108 and that is arranged coaxial with the connecting tube section 86*b* of the case member 86. Therefore, when a pipe member 109 press fitted into the connecting tube section 86*b* is fitted into the cylindrical section 107 through an annular seal member 110, the first water passage section 104 is connected to the second water passage section 108.

To the thermostat 74 there are connected an external pipe conduit member (not shown) that leads the cooling water from the water jacket 70, to the radiators 65, 66 and a water bypass passage 111 that bypasses the radiators 65,66 and leads the cooling water from the thermostat 74, to the water pump 73. A portion of the water bypass passage 111 is formed in an inner wall 63*a* of the cam chain chamber 63 such as to constitute a cam chain chamber side water passage section 112. This cam chain chamber side water passage section 112 is arranged to extend across the axes C of the cylinder bores 37 when viewed from the direction along the axis CC of the crankshaft 30.

The cam chain chamber side water passage section 112 is composed of a vertical passage portion 112*a* extending in the upward and downward direction one end of which is opened at the joining surface of the cylinder block 32 relative to the cylinder head 33 such as to communicate with a cylinder head side water passage section 113 of the water bypass passage 111 that is formed in the cylinder head 33 in communication with the thermostat 74, and a horizontal passage portion 112*b* extending in the forward and rearward direction one end of which is connected to a lower end of the vertical passage portion 112*a* and the other end of which is opened at a lateral wall of the engine main body 21 on the side where the water pump 73 is arranged with respect to the imaginary plane PL. Since the water pump 73 is located in front of the imaginary plane PL, the horizontal passage portion 112*b* is opened at a forward wall 32*a* of the cylinder block 32.

Figure 3:
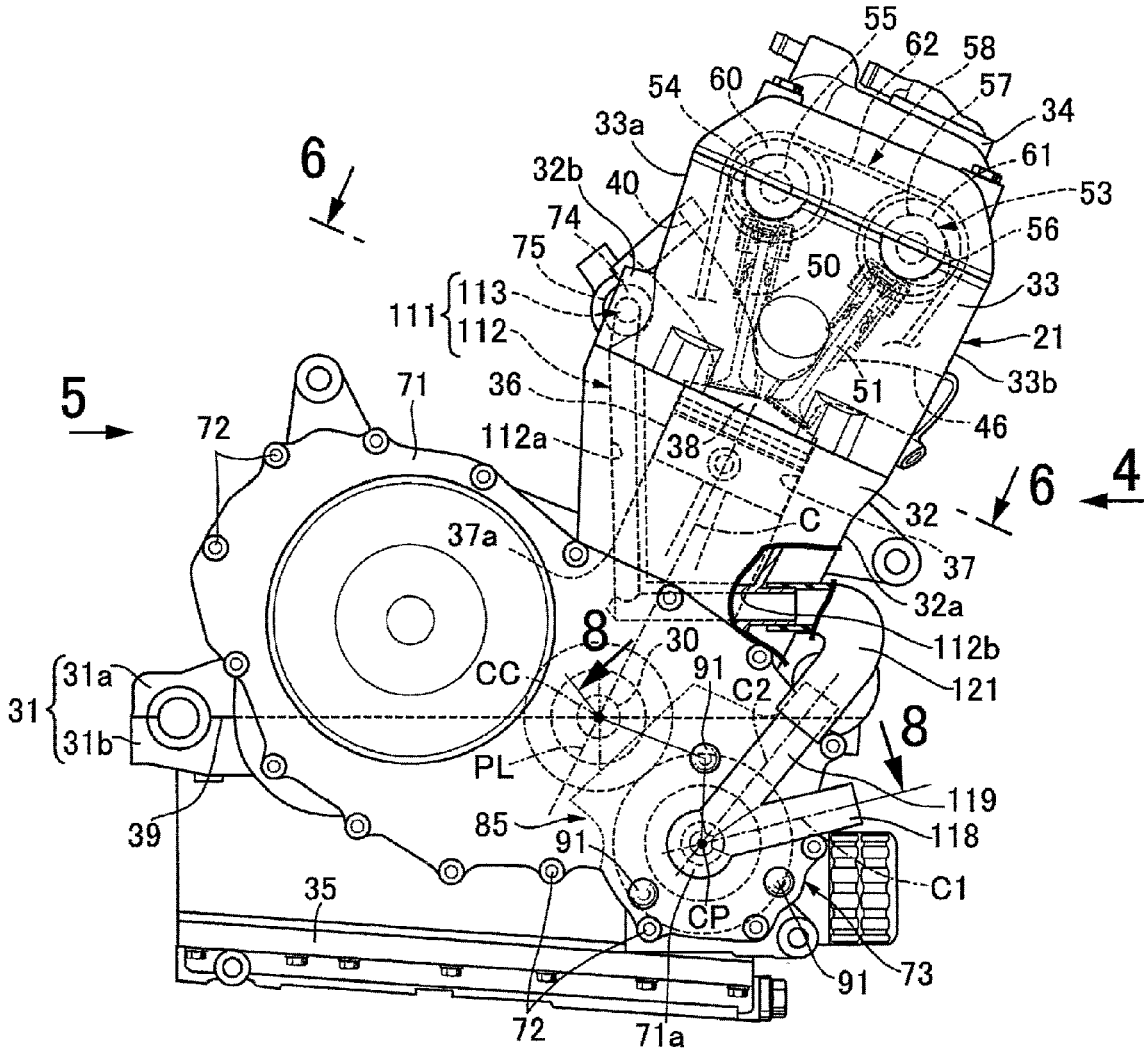
FIG. 3 is a side view of an engine main body, when viewed from the same direction as FIG. 1.
Figure 4:
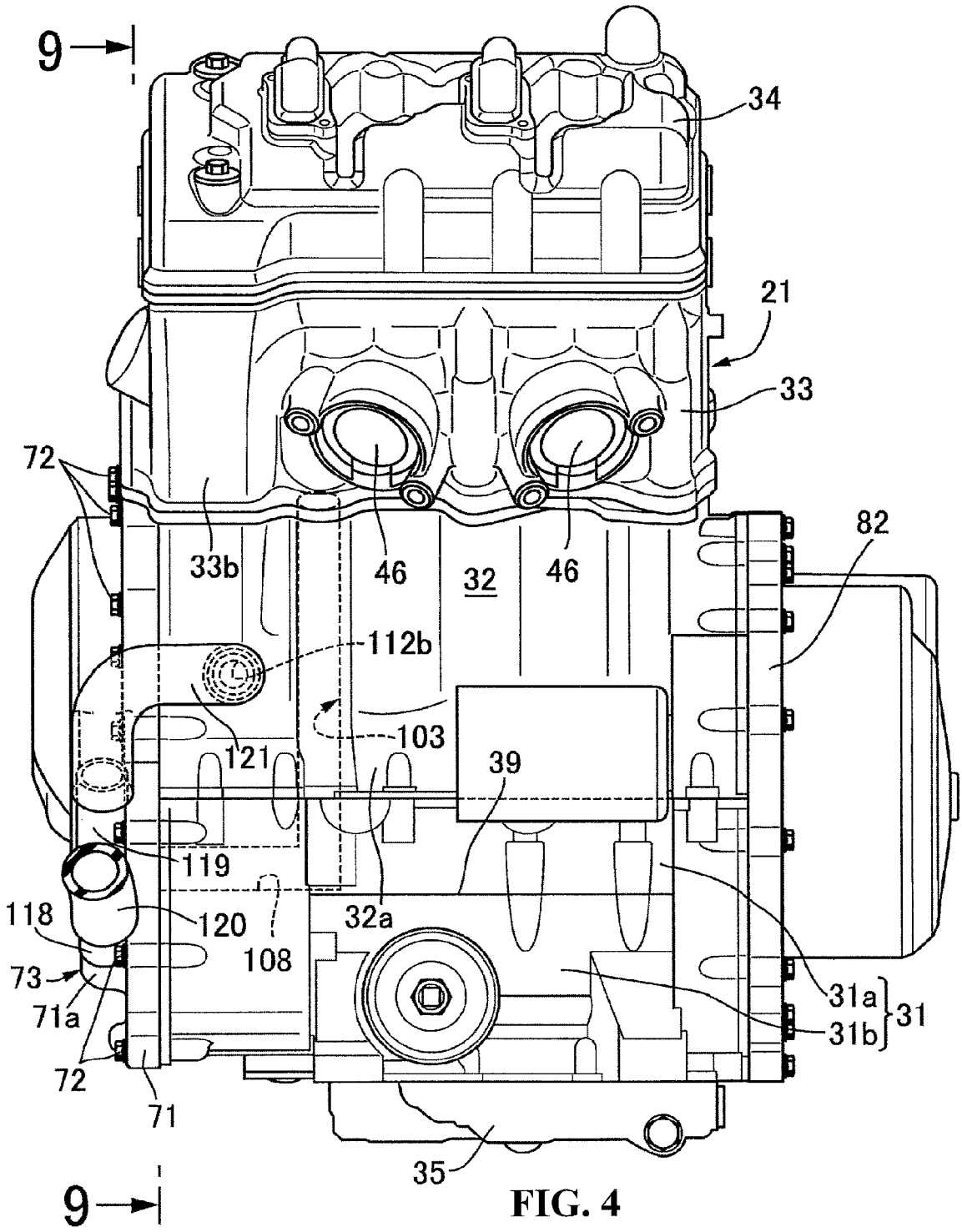
FIG. 4 is a view in the direction of an arrow 4 of FIG. 3.
Figure 5:
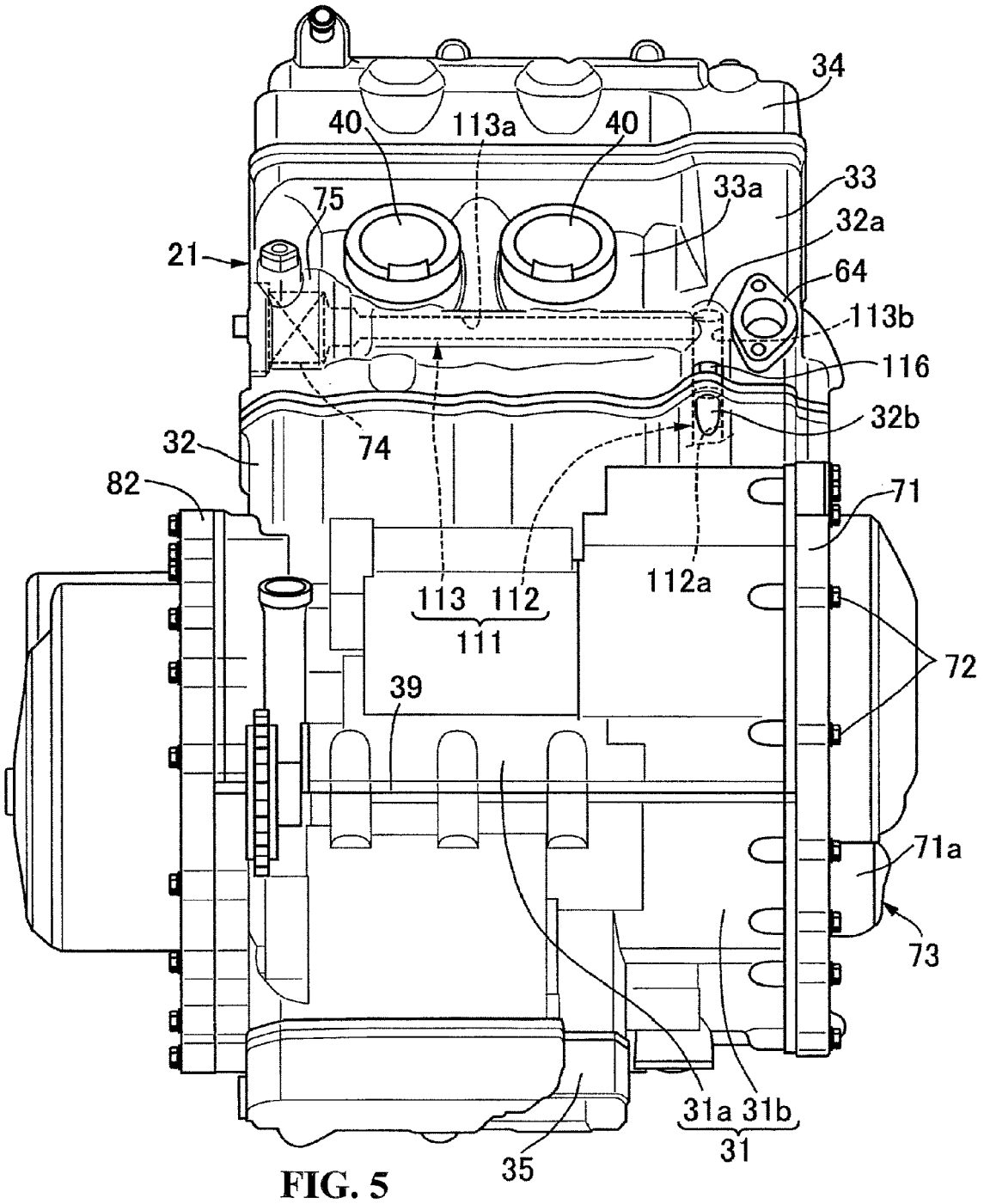
FIG. 5 is a view in the direction of an arrow 5 of FIG. 3.

Moreover, the vertical passage portion 112*a* of the cam chain chamber side water passage section 112 is formed to extend in the upward and downward direction in the direction orthogonal to the connecting surface 39 between the upward and downward divisible upper and lower half case bodies 31*a*, 31*b* that form the crankcase 31, in a side view when viewed from the direction along the axis CC of the crankshaft 30. A lower end of the vertical passage portion 112*a*, as clearly shown in FIG. 3, is located below lower ends 37*a* of the cylinder bores 37, in a side view when viewed from the direction along the axis CC of the crankshaft 30.

Further, the cylinder block 32 is integrally provided on the upper end portion thereof with a bulge portion 32*b* in a laterally bulging fashion in which a fastening hole 114 is provided for connecting the cylinder head 33. The one end of the vertical passage portion 112*a* of the cam chain chamber side water passage section 112 is opened at the bulge portion 32*b*.

Figure 6:
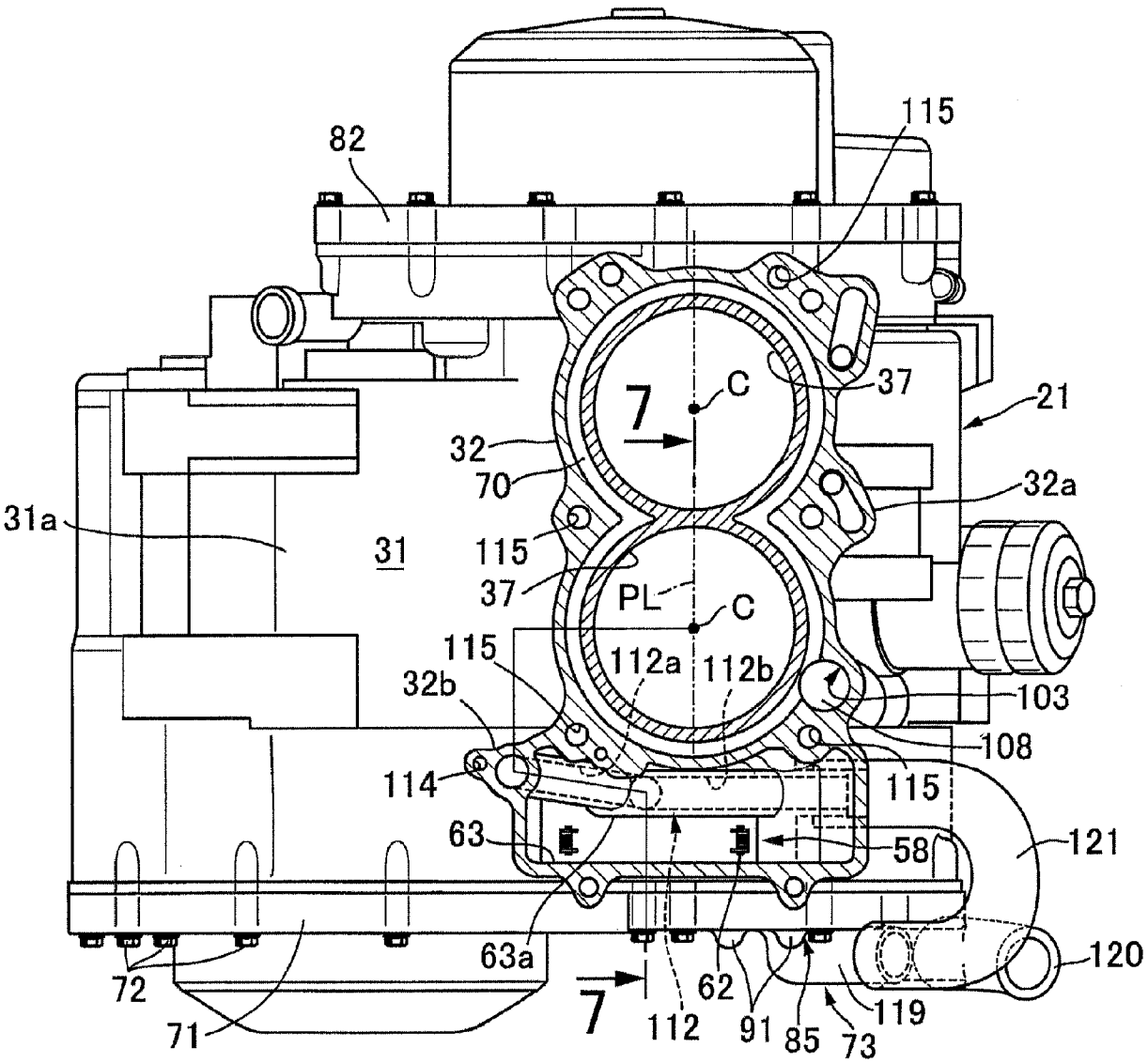
FIG. 6 is a cross sectional view taken along line 6-6 of FIG. 3.

In the outer peripheral portion of the cylinder block 32, as clearly shown in FIG. 6, there are provided a plurality of bolt fitting holes 115, 115 for connecting the cylinder head 33 and the cylinder block 32 to the crankcase 31. The cylinder head 33 sandwiches the cylinder block 32, together with the crankcase 31. However, in the bulge portion 32*b* there is provided the fastening hole 114 other than these bolt fitting holes 115, 115, and the bulge portion 32*b* is fastened to the cylinder head 33 by a bolt 116 (see FIG. 5) inserted into the fastening hole 114.

The cylinder head side water passage section 113 includes a second horizontal passage portion 113*a* one end of which is connected to the thermostat 74 and which extends in parallel to the axis CC of the crankshaft 30. A second vertical passage portion 113*b* extends in the upward and downward direction one end of which is connected to the other end of the second horizontal passage portion 113*a* and the other end of which is opened at the connecting surface of the cylinder head 33 to the cylinder block 32 such as to communicate with the vertical passage portion 112*a* of the cam chain chamber side water passage section 112. The cylinder head side water passage section 113 is formed in the rearward wall 33*a* of the cylinder head 33.

Referring to FIG. 8, on the crankcase cover 71 constituting the pump case 85 of the water pump 73 in cooperation with the case member 86, there is integrally formed a bottomed cylindrical suction case portion 71*a* which is bulged laterally in the direction along the central axis CP of the pump shaft 87 so as to form a suction chamber 117 in communication with the pump chamber 89. To the suction case portion 71*a* there are connected a first cooling water inlet pipe portion 118 for introducing the cooling water having circulated through the radiators 65, 66, into the suction chamber 117 of the water pump 73, and a second cooling water inlet pipe portion 119 for introducing the cooling water from the water bypass passage 111 into the suction chamber 117 of the water pump 73.

The first and second cooling water inlet pipe portions 118, 119 are formed to extend rectilinearly. The first cooling water inlet portion 118 is connected to the suction case portion 71*a* in a state of being directed to the right side radiator 66 of the pair of left and right radiators 65, 66. The connection between the lower tank 66*b* of the right side radiator 66 and the first cooling water inlet pipe portion 118 is established through an outer pipe conduit member 120 such as a hose and the like.

Further, the second cooling water inlet pipe portion 119 is connected to the suction case portion 71*a* and is directed to a downstream end of the water bypass passage 111, namely, the opened end of the horizontal passage portion 112*b* of the cam chain chamber side water passage section 112 relative to the forward wall 32*a* of the cylinder block 32. The cylinder block 32 and the second cooling water inlet pipe portion 119 are connected to each other through an external pipe conduit member 121 such as a hose and the like.

Moreover, as clearly shown in FIG. 3, a relative arrangement between the first and second cooling water inlet pipe portions 118, 119 is configured such that extension lines of central axes C1, C2 of these cooling water inlet pipe portions 118, 119 intersect each other at a rotation axis of the water pump 73, namely at the central axis CP of the pump shaft 87.

Next, the operation of this embodiment will be described.

A portion of the water bypass passage 111 which bypasses the radiators 65, 66 and leads the cooling water from the thermostat 74 to the water pump 73 is formed in the inner wall 63*a* of the cam chain chamber 63 such as to constitute the cam chain chamber side water passage section 112. This cam chain chamber side water passage section 112 is arranged to extend across the axes C of the cylinder bores 37 when viewed from the direction along the axis CC of the crankshaft 30. With this construction, even in the case where a portion of the water bypass passage 111 extends across the axes C of the cylinder bores 37 when viewed from the direction along the axis CC of the crankshaft 30, there is no need for arranging the pipe conduit member on the lateral side of the engine main body 21 whereby to avoid injuring the external appearance and to reduce the part of the water bypass passage 111 constituted by the pipe conduit member. In addition, it is possible to prevent the increase in size in the width direction of the internal combustion engine.

Further, the cam chain chamber side water passage section 112 includes vertical passage portion 112*a* extending in the upward and downward direction one end of which is opened at the joining surface of the cylinder block 32 relative to the cylinder head 33 such as to communicate with the cylinder head side water passage section 113 of the water bypass passage 111 that is formed in the cylinder head 33 in communication with the thermostat 74, and the horizontal passage portion 112*b* extending in the forward and rearward direction one end of which is connected to the lower end of the vertical passage portion 112*a* and the other end of which is opened at the forward wall 32*a* of the cylinder block 32 of the engine main body 21 on the side where the water pump 73 is arranged with respect to the imaginary plane PL including the axis CC of the crankshaft 30 and the axes C of the cylinder bores 37. With this construction, the cam chain chamber side water passage section 112 can be easily worked, and the external pipe conduit member 121 extending between the cam chain chamber side water passage section 112 and the water pump 73 can be reduced in length.

Further, the crankcase 31 is composed of the upper half case body 31*a* formed integral with the cylinder block 32 and the lower half case body 31*b* which are connected to each other in a divisible fashion. When viewed from the direction along the axis CC of the crankshaft 30, the lower end of the vertical passage portion 112*a* is arranged lower than the lower ends 37*a* of the cylinder bores 37, and the water pump 73 is arranged on the crankcase cover 71 such as to be located in a position overlapping with the crankcase 31. With this construction, the horizontal passage portion 112*b* one end of which communicates with the lower end portion of the vertical passage portion 112*a* allows the position of the other opened end portion thereof to be lowered thereby approaching the crankcase 31 side, so that the space between the cam chain chamber side water passage section 112 and the water pump 73 is reduced as far as possible.

Further, since the thermostat 74 is arranged to the rear of the imaginary plane PL while the water pump 73 is arranged forwardly of the imaginary plane PL, it is possible to improve the external appearance when viewed from the forward side of the internal combustion engine E, and the thermostat 74 can be arranged while effectively utilizing the space on the rear surface side of the engine main body 21.

Moreover, the thermostat 74 and the water pump 73 are arranged to put the pair of cylinder bores 37 therebetween in the direction along the axis CC of the crankshaft 30. Therefore, the piping from the radiators 65, 66 extends to both end sides of the engine main body 21 along the axis CC of the crankshaft 30, whereby to improve the external appearance and to distribute the weight of the cooling system equally in the vehicle width direction.

Further, the engine main body 21 is mounted on the vehicle body frame F in such a condition that the axes of the cylinder bores 37 are inclined forwardly and upwardly. In addition, the vertical passage portion 112*a* of the cam chain chamber side water passage section 112 is formed to extend in the upward and downward direction in the direction orthogonal to the connecting surface 39 between the upper and lower half case bodies 31*a*, 31*b* which forms the crankcase 31, in a side view when viewed from the direction along the axis CC of the crankshaft 30. With this construction, there is no need for allowing a portion of a rearward wall of the cylinder block 32 to bulge rearwardly. Thus, it is possible to secure the space for arranging component parts of the vehicle, etc. on the rear side of the cylinder block 32.

Further, the cylinder block 32 is integrally provided on the upper end portion thereof with the bulge portion 32*b* in a laterally bulging fashion in which the fastening hole 114 for connecting the cylinder head 33 is provided. One end of the vertical passage portion 112*a* of the cam chain chamber side water passage section 112 is opened at the bulge portion 32*b*. Accordingly, the fastening portion between the cylinder block 32 and the cylinder head 33 is provided in the vicinity of the connecting portion between the cylinder head side water passage section 113 and the cam chain chamber side water passage section 112, whereby it is possible to enhance the sealing performance with respect to the connecting portion between the cylinder head side water passage section 113 and the cam chain chamber side water passage section 112.

Further, since the cylinder head side water passage section 113 is composed of the second horizontal passage portion 113*a* one end of which is connected to the thermostat 74 and which extends in parallel to the axis CC of the crankshaft 30, and the second vertical passage portion 113*b* extending in the upward and downward direction one end of which is connected to the other end of the second horizontal passage portion 113*a* and the other end of which is opened at the connecting surface of the cylinder head 33 relative to the cylinder block 32 such as to communicate with the vertical passage portion 112*a* of the cam chain chamber side water passage section 112, the portion of the water bypass passage 111 extending from the thermostat 74 to a place where the horizontal passage portion 112*b* of the cam chain chamber side water passage section 112 is opened at the lateral wall of the engine main body 21 is formed in the engine main body 21 whereby to contribute toward shortening a portion formed by the external pipe conduit member. In addition, when the engine is cold and the cooling water circulates through the water bypass passage 111, there is a rapid rise in temperature of the cooling water.

Further, since the cylinder head side water passage section 113 and the intake ports 40, 40 are formed in the rearward wall 33*a* of the cylinder head 33, the water collected in the cylinder head side water passage section 113 in such a condition that the water bypass passage 111 is closed after completing the warming-up of the engine, is restrained from having a thermal influence from the engine main body 21.

In addition, since the exhaust ports 46 are provided in the forward wall 33*b* of the cylinder head 33, and the upstream ends of the exhaust pipes 47, 48 extending from the front side of the engine main body 21 through the under side of the engine main body 21 to the rear side thereof are connected to the forward wall 33*b* of the cylinder head 33, the pipe conduit member 121 establishing the connection between the water bypass passage 111 and the water pump 73 is covered on the front and under sides with the exhaust pipes 46, 47, whereby to improve the external appearance. Also, the pipe conduit member 121, the water bypass passage 111 of the pipe conduit member 121 and the connecting portion to the water pump 73 can be protected from debris such as sandy dust and the like swirled up by the front wheel WF.

Further, the crankcase cover 71 is connected to the right lateral surface of the crankcase 31. The case member 86 that forms the pump case 85 of the water pump 73 in cooperation with the crankcase cover 71 and that rotatably supports the pump shaft 87 of the water pump 73 is attached to the inner surface side of the crankcase cover 71. Accordingly, the fastening member is not exposed on the outer surface side of the crankcase cover 71 whereby to improve the external appearance, and the pump case 85 does not protrude from the crankcase cover 71 whereby the internal combustion engine E can be compact in the width direction thereof.

Furthermore, since the first water passage section 104 that is a portion of the water supply passage 103 leading the cooling water discharged from the water pump 73 to the water jacket 70 is formed between the joining surfaces of the crankcase cover 71 and the case member 86, there is no need for a discharge pipe portion for discharging the cooling water from the water pump 73 to be provided on the pump case 85 in a projecting fashion from the pump case 85, whereby it is possible to make the internal combustion engine more compact.

Moreover, since the first water passage section 104 is connected to the second water passage section 108 that constitutes a portion of the water supply passage 103 and which is formed in the crankcase 31, the water passage section extending from the water pump 73 to the crankcase 31 is housed in the inside of the internal combustion engine E, whereby the number of component parts can be reduced and the external appearance can be improved.

Further, the first cooling water inlet pipe portion 118 for introducing the cooling water from the radiators 65, 66, into the water pump, and the second cooling water inlet pipe portion 119 for introducing into the water pump 73 the cooling water from the water bypass passage 111 which leads the cooling water circulating while bypassing the radiators 65, 66 from the water jacket 70 formed in the engine main body 21, are provided on the crankcase cover 71. Accordingly, in comparison with the construction in which the first and second cooling water inlet pipe portions are arranged on a pump cover that is attached to the crankcase 31 from the outside, the internal combustion engine E can be made to be compact. In addition, there is no need for avoiding the location where the case member 86 is fastened to the crankcase cover 71, in order for arranging the first and second cooling water inlet pipe portions 118, 119, whereby it is possible to increase a degree of freedom of arrangement with respect to the first and second cooling water inlet pipe portions 118, 119.

Further, since the relative arrangement between the first and second cooling water inlet pipe portions 118, 119 each of which extends rectilinearly is configured such that extension lines of central axes C1, C2 of these cooling water inlet pipe portions 118, 119 intersect each other at a rotation axis of the water pump 73, namely, at the central axis CP of the pump shaft 87, the first and second cooling water inlet pipe portions 118, 119 are prevented from protruding from the crankcase cover 71. Thus, the internal combustion engine E can be more compact.

Further, since the water pump 73 is driven by the balancer shaft 78 that is operatively connected to the crankshaft 30, there is no need for providing an exclusive pump driving shaft to operate the water pump 73, whereby the number of component parts can be reduced. In addition, there is no need for providing an arrangement space for the exclusive pump driving shaft. Thus, the internal combustion engine E can be made more compact.

Moreover, the projection 97 is provided on the end portion of the balancer shaft 78, and the groove 98 is provided on the end surface, corresponding to the end portion of the balancer shaft 78, of the pump shaft 87 which is coaxial with the balancer shaft 78, so as to be engaged with the projection 97, wherein the pump shaft 87 is operated through the coaxial projection and groove engagement between the balancer shaft 78 and the pump shaft 87. Accordingly, there is no need for providing an exclusive connecting member such as a tightening means and the like for connecting the balancer shaft 78 and the pump shaft 87, whereby the number of component parts can be reduced and the assembling operation can be easily performed.

Further, since the balancer weight 99 is provided on one end portion of the balancer shaft 78 corresponding coaxially to the pump shaft 87 on the side external to the crankcase 31, the balancer shaft 78 and the crankshaft 30 can be arranged close to each other, so that the engine main body 21 can be compact in the direction orthogonal to the axis CC of the crankshaft 30.

Furthermore, since the balancer weight 99 has the recess 100 for staying clear of the case member 86 of the water pump 73, the balancer shaft 78 and the case member 86 can be arranged close to each other in the axial direction of the crankshaft 30. Thus, it is possible to make the internal combustion engine E more compact in the direction along the axis CC of the crankshaft 30.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water cooled internal combustion engine for a vehicle comprising:

a crankcase constituting a portion of an engine main body mounted on a vehicle body frame, and rotatably supporting a crankshaft;

a crankcase cover for covering a lateral side of the crankcase, said crankcase cover being attached to the crankcase;

a pump driving shaft operated by power transmitted from the crankshaft, said pump driving shaft being rotatably supported on an axis parallel to the crankshaft by the crankcase;

a water pump driven through the pump driving shaft, said water pump having a pump shaft with an axis of rotation coaxial with the pump driving shaft and said pump driving shaft being rotatably supported on the crankcase cover;

a case member having a first side and a second side, a shaft support section formed on the first side thereof for rotatably supporting the pump drive shaft;

an impeller operatively connected to the pump drive shaft and being disposed on the second side of the case member; and a pump chamber formed between the second side of the case member and said crankcase cover for forming said pump chamber of the water pump, said second side of the case member being attached on an inner surface side of the crankcase cover to form said pump chamber between the second side of the case member and the crankcase cover.

2. The water cooled internal combustion engine for a vehicle according to claim 1, and further comprising a water passage section being a portion of a water supply passage leading cooling water discharged from the water pump to a water jacket formed in the engine main body, wherein the water passage section is formed between joining surfaces of the crankcase cover and the case member.

3. The water cooled internal combustion engine for a vehicle according to claim 2, and further comprising a second water passage section being formed in the crankcase to constitute a portion of the water supply passage, wherein the water passage section formed between the joining surfaces of the crankcase cover and the case member is in communication with the second water passage section.

4. The water cooled internal combustion engine for a vehicle according to claim 1, and further comprising a first cooling water inlet pipe portion for introducing cooling water having circulated through a radiator, into the water pump, and a second cooling water inlet pipe portion for introducing into the water pump the cooling water from a water bypass passage that leads the cooling water circulating, while bypassing the radiator, from the water jacket formed in the engine main body, wherein the first and second cooling water inlet pipe portions are provided on the crankcase cover.

5. The water cooled internal combustion engine for a vehicle according to claim 2, and further comprising a first cooling water inlet pipe portion for introducing cooling water having circulated through a radiator, into the water pump, and a second cooling water inlet pipe portion for introducing into the water pump the cooling water from a water bypass passage that leads the cooling water circulating, while bypassing the radiator, from the water jacket formed in the engine main body, wherein the first and second cooling water inlet pipe portions are provided on the crankcase cover.

6. The water cooled internal combustion engine for a vehicle according to claim 3, and further comprising a first cooling water inlet pipe portion for introducing cooling water having circulated through a radiator, into the water pump, and a second cooling water inlet pipe portion for introducing into the water pump the cooling water from a water bypass passage that leads the cooling water circulating, while bypassing the radiator, from the water jacket formed in the engine main body, wherein the first and second cooling water inlet pipe portions are provided on the crankcase cover.

7. The water cooled internal combustion engine for a vehicle according to claim 4, wherein a relative arrangement between the first and second cooling water inlet pipe portions each of which extends rectilinearly is configured such that extension lines of central axes of these cooling water inlet pipe portions intersect each other at an axis of rotation of the water pump.

8. The water cooled internal combustion engine for a vehicle according to claim 1, wherein the pump driving shaft functions as a balancer shaft operatively connected to the crankshaft.

9. The water cooled internal combustion engine for a vehicle according to claim 2, wherein the pump driving shaft functions as a balancer shaft operatively connected to the crankshaft.

10. The water cooled internal combustion engine for a vehicle according to claim 3, wherein the pump driving shaft functions as a balancer shaft operatively connected to the crankshaft.

11. The water cooled internal combustion engine for a vehicle according to claim 4, wherein the pump driving shaft functions as a balancer shaft operatively connected to the crankshaft.

12. The water cooled internal combustion engine for a vehicle according to claim 7, wherein the pump driving shaft functions as a balancer shaft operatively connected to the crankshaft.

13. The water cooled internal combustion engine for a vehicle according to claim 8, wherein one of a projection and a groove is provided on an end portion of the balancer shaft, and the other of the projection and groove is provided on an end surface, corresponding to the end portion of the balancer shaft, of the pump shaft which is coaxial with the balancer shaft, so as to be engaged with the one of the projection and groove.

14. The water cooled internal combustion engine for a vehicle according to claim 13, further comprising a balancer weight having a recess for staying clear of the case member of the water pump, wherein the balancer weight is provided on the end portion of the balancer shaft coaxially opposite to the pump shaft on the side external to the crankcase.

15. A water cooled internal combustion engine for a vehicle comprising:

a crankcase for rotatably supporting a crankshaft;

a crankcase cover operatively connected to said crankcase for covering a lateral side of the crankcase;

a pump driving shaft operatively connected to the crankshaft, said pump driving shaft being rotatably supported on an axis parallel to the crankshaft by the crankcase;

a water pump operatively connected to the pump driving shaft, said water pump having a pump shaft with an axis of rotation coaxial with the pump driving shaft and said pump driving shaft being rotatably supported on the crankcase cover;

a case member having a first side and a second side, a shaft support section formed on the first side thereof for rotatably supporting the pump drive shaft;

an impeller operatively connected to the pump drive shaft and being disposed on the second side of the case member; and a pump chamber formed between the second side of the case member and said crankcase cover for forming said pump chamber of the water pump, said second side of the case member being attached on an inner surface side of the crankcase cover to form said pump chamber between the second side of the case member and the crankcase cover.

16. The water cooled internal combustion engine for a vehicle according to claim 15, and further comprising a water passage section being a portion of a water supply passage leading cooling water discharged from the water pump to a water jacket formed in the engine main body, wherein the water passage section is formed between joining surfaces of the crankcase cover and the case member.

17. The water cooled internal combustion engine for a vehicle according to claim 16, and further comprising a second water passage section being formed in the crankcase to constitute a portion of the water supply passage, wherein the water passage section formed between the joining surfaces of the crankcase cover and the case member is in communication with the second water passage section.

18. The water cooled internal combustion engine for a vehicle according to claim 15, and further comprising a first cooling water inlet pipe portion for introducing cooling water having circulated through a radiator, into the water pump, and a second cooling water inlet pipe portion for introducing into the water pump the cooling water from a water bypass passage that leads the cooling water circulating, while bypassing the radiator, from the water jacket formed in the engine main body, wherein the first and second cooling water inlet pipe portions are provided on the crankcase cover.

19. The water cooled internal combustion engine for a vehicle according to claim 18, wherein a relative arrangement between the first and second cooling water inlet pipe portions each of which extends rectilinearly is configured such that extension lines of central axes of these cooling water inlet pipe portions intersect each other at an axis of rotation of the water pump.

20. The water cooled internal combustion engine for a vehicle according to claim 15, wherein the pump driving shaft functions as a balancer shaft operatively connected to the crankshaft.

* * * * *